United States Patent [19]

Boris

[11] 4,082,222

[45] Apr. 4, 1978

[54] ATOMIZED LIQUID DISPENSING PUMP

[76] Inventor: Michel Boris, 45 Boulevard Suchet, Paris 75016, France

[21] Appl. No.: 708,012

[22] Filed: Jul. 23, 1976

[30] Foreign Application Priority Data

Aug. 14, 1975 France ..... 75 25833

[51] Int. Cl.[2] ..... B05B 9/04

[52] U.S. Cl. ..... 239/331; 222/321; 222/373; 222/385

[58] Field of Search ..... 239/331, 333, 329; 222/321, 372, 373, 378, 379, 381, 383–385

[56] References Cited

U.S. PATENT DOCUMENTS

| | | | |
|---|---|---|---|
| 3,239,151 | 3/1966 | Boris | 239/333 |
| 3,583,605 | 6/1971 | Corsette | 222/321 |
| 3,746,260 | 7/1973 | Boris | 222/385 X |
| 3,923,250 | 12/1975 | Boris | 222/385 X |

*Primary Examiner*—Bruce H. Stoner, Jr.
*Assistant Examiner*—Andres Kashnikow
*Attorney, Agent, or Firm*—Eyre, Mann, Lucas & Just

[57] ABSTRACT

An atomizer assembly comprises a nozzle mounted in a push-button mounted on a tubular extension to a first piston of the assembly. The first piston is slidable in a first cylinder or pump chamber and defines a seat of a valve. A valve member co-operating with the seat forms part of a second piston slidable in a second cylinder defined by the first piston. Depression of the push-button causes pressure in the pump chamber to increase and at a certain point the valve member is lifted from the seat so that liquid under pressure passes to the nozzle.

6 Claims, 1 Drawing Figure

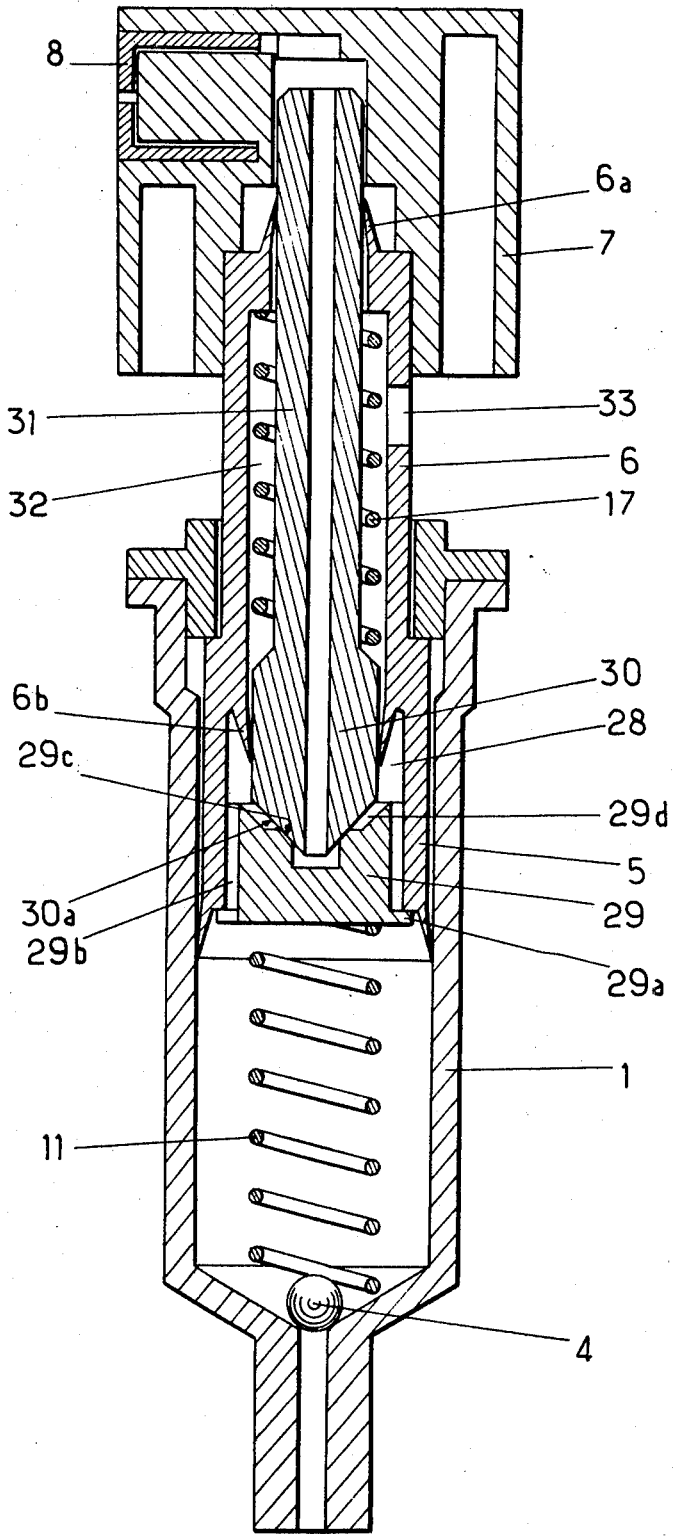
8
6a
7
31
33
6
32
17
30
6b
28
29c
29d
5
30a
29
29b
29a
1
11
4

ATOMIZED LIQUID DISPENSING PUMP

BACKGROUND OF THE INVENTION

1. Field of the Invention

This invention relates to atomizers for use, for example, in atomizing perfume.

2. Description of the Prior Art

U.S. Pat. No. 3,746,260 describes and claims a liquid atomizer comprising a hollow, first, piston slidable in a first cylinder, an atomizing nozzle communicating with the hollow piston, a second cylinder of smaller cross-section than the first cylinder and communicating with the first cylinder, a second piston slidable in the second cylinder, valve means connected to the second piston and disposed to interrupt communication between the first cylinder and the nozzle, a first spring acting on the second piston and biasing the valve means to a position in which the said communication is interrupted, a dip tube communicating with a space defined by the two cylinders through a non-return valve, the second cylinder being disposed within the first piston and being movable with respect to the first cylinder, and a second spring acting to bias the two cylinders apart.

The second cylinder of this previous proposal is constituted by a recess formed in the first piston and is movable with respect to the first cylinder. When the first piston is moved, the liquid in the first cylinder is forced into the second cylinder in which the pressure increases. The second piston is then displaced by the pressure within its cylinder against the action of resilient means which act on it. When this pressure reaches a sufficient value to balance this action, the second piston moves and entrains the valve which is connected to it, so that the cylinders are placed in communication with the atomizing nozzle.

SUMMARY OF THE INVENTION

According to the present invention there is provided in an atomizer means defining a first cylinder forming a pump chamber, a dip tube in communication with the pump chamber, a hollow piston slidable within the pump chamber and defining a second cylinder in communication with the pump chamber and defining a valve seat, a second piston slidable in the second cylinder and defining a valve member, an atomizing nozzle in communication with the second cylinder, under the control of the valve member and the seat defined by the said hollow piston, resilient means biasing the valve member to a closed position, a hollow extension to the second piston providing a communication path to the atomizing nozzle from the second cylinder, and a tubular extension to the first piston, the hollow extension being slidable in the tubular extension of the first piston.

BRIEF DESCRIPTION OF THE DRAWING

An embodiment of an atomizer in accordance with the invention will now be described, by way of example, with reference to the accompanying drawing, the sole FIGURE of which is a longitudinal section of the atomizer.

DESCRIPTION OF THE PREFERRED EMBODIMENT

Referring now to the drawing, the atomizer includes a pump chamber 1, having a lower part in communication with a dip tube through the intermediary of a non-return valve 4 and a hollow piston 5 slidable in the pump chamber. The pump chamber is in the form of a hollow cylinder.

A second cylinder or chamber 28 is formed by the piston 5 and is separated from the pump chamber 1 by the seat of a valve member 29. The latter comprises an annular flange **29*a* held in abutment against an end surface of the piston 5 by a return spring 11 acting on the piston. Longitudinally-extending passages 29*b* formed in the periphery of the valve 29 provide for communication between the chamber 1 and the cylinder 28**.

A further valve member 30 lies within the cylinder 28 and has a frusto-conical face **30*a* which seats on a frusto-conical surface 29*c* of the valve 29. The valve member also acts as a piston. To this end, an annular frusto-conical bleed passage 29*d* is machined in the seat of the valve 29, outwardly of the surface 29*c* so that the liquid pressure in the chamber 28** acts on a part of the frusto-conical face of the valve.

The piston/valve 30 is recessed axially and is extended by a hollow tube 31 which extends within a tube 6 integral with piston 5, to a push-button 7. The tube 31 is slidable within the push-button. The hollow tube 31 is mounted in a fluid-type manner in the tube 6 by means of two annular lips **6*a* and 6*b* carried by the tube 6 and abutting against the tube 31. A spring 17 acts within an annular section space 32 formed between the two tubes 6 and 31 and biases the valve 30 on to the seat 29*c*. An opening 33 enables the return to the reservoir of any liquid which has seeped into the annular-section space 32, past the tube 31 and the lips 6*a* or 6*b***.

In the position illustrated in the drawing, the atomizer is at rest, and the valve 30 is seated on the seat **29*c* under the action of the spring 17, so that the chamber 1 is shut off from the nozzle 8. When the user presses the push-button 7, the piston 5 is displaced in the chamber 1** and the pressure of the liquid in the chamber therefore increases.

Since the chamber 28 is in communication with the chamber 1, the pressure in the latter chamber also increases. This pressure acts on the frusto-conical surface **30*a* of the valve 30 in the direction tending to open the valve; in other words the pressure acts to oppose the force exerted by the spring 17**.

When the pressure is sufficient, the valve member 30 is unseated from the seat **29*c* and the liquid flows under pressure to the nozzle 8 through the central passage in the piston/valve 30**.

When the user releases the push-button 7, the pressure in the chamber 1 immediately falls and the valve 30 is reapplied to its seat by the spring 17. The piston 5 is also returned to its initial position by the spring 11.

I claim:

1. In an atomizer:

(a) means defining a first cylinder forming a pump chamber;

(b) a dip tube in communication with the pump chamber;

(c) a hollow first piston slidable within the pump chamber, said hollow piston defining a second cylinder in communication with the pump chamber and defining a valve seat;

(d) a second piston slidable in said second cylinder and defining a valve member;

(e) an atomizing nozzle in open communication with the said second cylinder through a bore in said second piston said atomizing nozzle being in open communication with said second cylinder only when the valve member and the valve seat are spaced apart;

(f) first resilient means biasing the first piston towards one end of said pump body and second resilient means biasing the second piston towards the other end of said pump body and urging said valve member against said valve seat; and (g) pressure applied to said first piston causing pressure to build up in said pump chamber until the biasing force of said second resilient means is overcome and the valve member and valve seat become spaced apart thus establishing said open communication between the atomizing nozzle and the said second cylinder.

2. An atomizer according to claim 1 further including a hollow extension to the second piston and a tubular extension to the first piston, said hollow extension being slidable in said tubular extension.

3. An atomizer according to claim 2 comprising a member carrying the said atomizing nozzle, said hollow extension being slidable in said member and said member being rigid with said tubular extension.

4. An atomizer according to claim 1, wherein the valve member has an axial passage.

5. An atomizer according to claim 1, wherein the valve seat has passages in its periphery providing communication between the two cylinders.

6. An atomizer according to claim 1 wherein the valve member and the valve seat thereof have complementary frusto-conical surfaces and the seat has an annular bleed passage outwardly of the frusto-conical surface thereof.

* * * * *